US006283466B1

(12) United States Patent
Jaeger

(10) Patent No.: US 6,283,466 B1
(45) Date of Patent: Sep. 4, 2001

(54) DEVICE FOR PRODUCING PRINTED MATERIALS IN SEVERAL PARTS

(75) Inventor: Erich Jaeger, Frauenfeld (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/367,465

(22) PCT Filed: Jan. 20, 1998

(86) PCT No.: PCT/CH98/00015

§ 371 Date: Aug. 13, 1999

§ 102(e) Date: Aug. 13, 1999

(87) PCT Pub. No.: WO98/35901

PCT Pub. Date: Aug. 20, 1998

(30) Foreign Application Priority Data

Feb. 14, 1997 (CH) ..... 325/97

(51) Int. Cl.[7] ..... B65H 39/055

(52) U.S. Cl. ..... 270/52.23; 270/52.27; 270/52.29; 270/58.29

(58) Field of Search ..... 270/52.14, 52.16, 270/52.22, 52.26, 52.29, 58.26, 58.29, 52.18, 52.2, 52.23

(56) References Cited

U.S. PATENT DOCUMENTS

| | | | | |
|---|---|---|---|---|
| 1,441,278 | | 1/1923 | Halvorsen . | |
| 1,659,099 | * | 2/1928 | Halvorsen | 270/52.23 |
| 2,873,113 | * | 2/1959 | McWhorter | 270/52.29 X |
| 3,938,799 | * | 2/1976 | Macke | 270/52.26 |
| 4,133,521 | * | 1/1979 | Muller | 270/52.2 |
| 4,486,011 | | 12/1984 | Rolf . | |
| 5,116,033 | | 5/1992 | Werner . | |
| 5,921,538 | * | 7/1999 | Schlough | 270/52.18 |
| 6,095,511 | * | 8/2000 | Jager | 270/52.29 |

FOREIGN PATENT DOCUMENTS

| | | | |
|---|---|---|---|
| 295 098 | | 2/1954 | (CH) . |
| 3135930A1 | * | 6/1982 | (DE) . |
| 0 080 185 A1 | | 6/1983 | (EP) . |
| 0 346 579 A1 | | 12/1989 | (EP) . |

* cited by examiner

*Primary Examiner*—Christopher P. Ellis
*Assistant Examiner*—Patrick Mackey
(74) *Attorney, Agent, or Firm*—Alston & Bird LLP

(57) ABSTRACT

An apparatus for producing multi-part printed products comprising an upwardly open V-shaped continuous conveying channel (1), and a V-shaped processing channel (2) arranged above the conveying channel (1). A plurality of supply locations (11–17) are arranged serially along the processing route for supplying the printed product parts (A–G). The processing channel (2) has individual successive processing regions (3–10) which receive the product parts supplied at the supply locations and between which through-passages (18, 19, 119, 20, 120) are provided which open toward the bottom and by means of which the product parts (A–G) pass out of the processing region and into the underlying conveying channel (1).

14 Claims, 11 Drawing Sheets

Fig.4
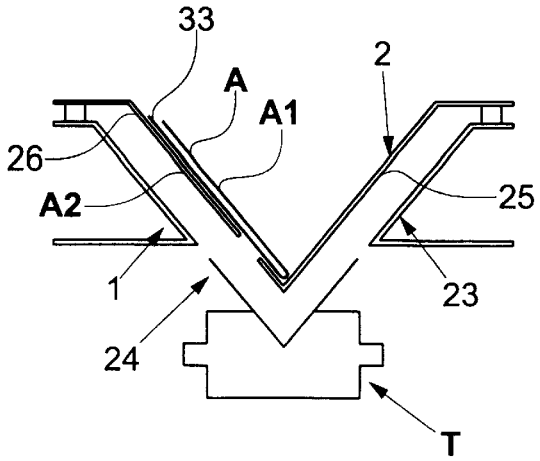
Fig.5
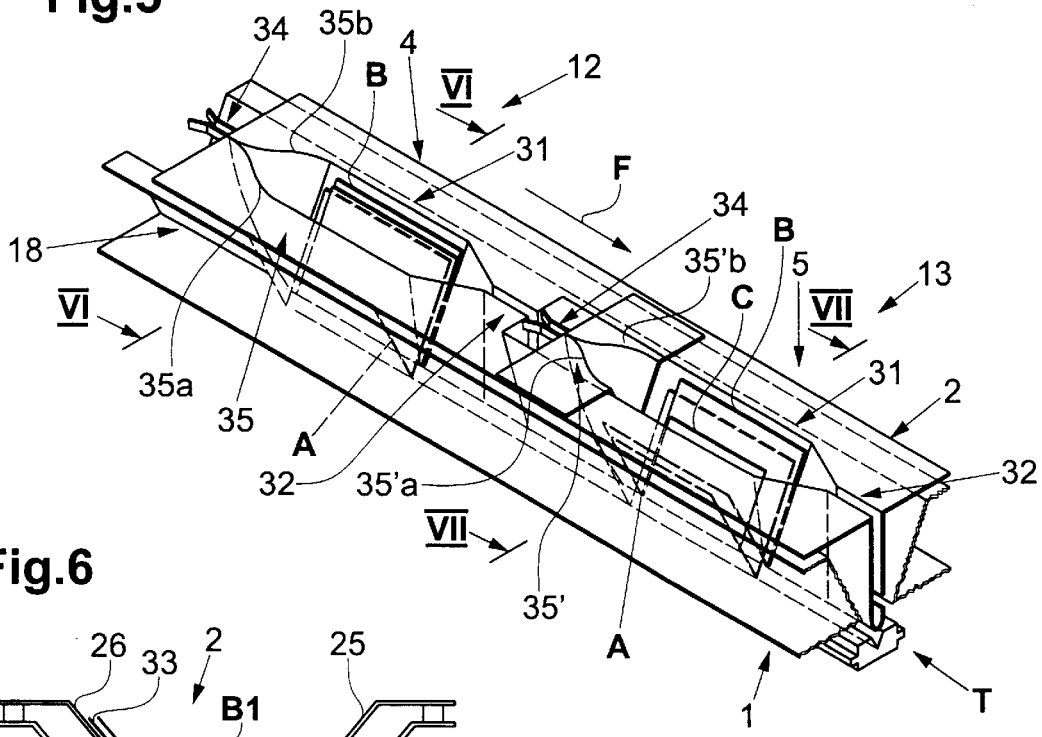
Fig.6
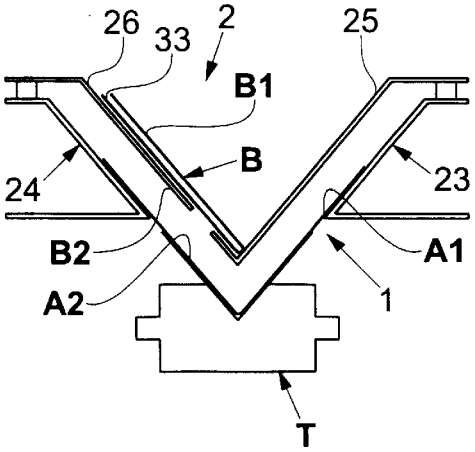
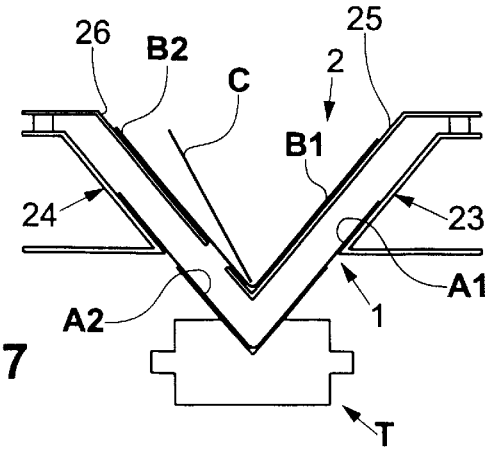
Fig.7

Fig.8
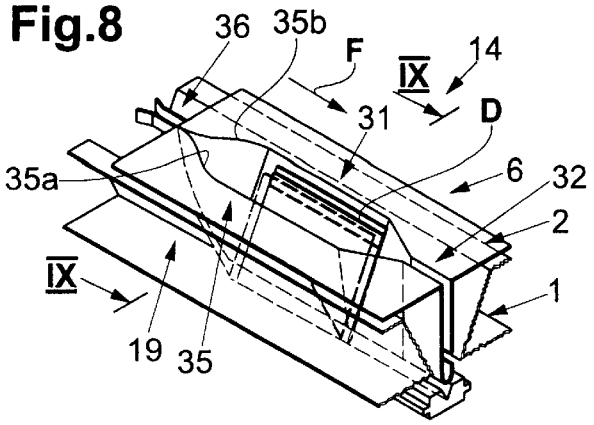
Fig.9
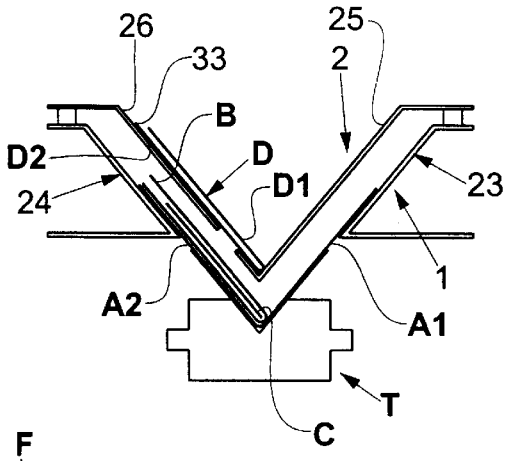
Fig.10
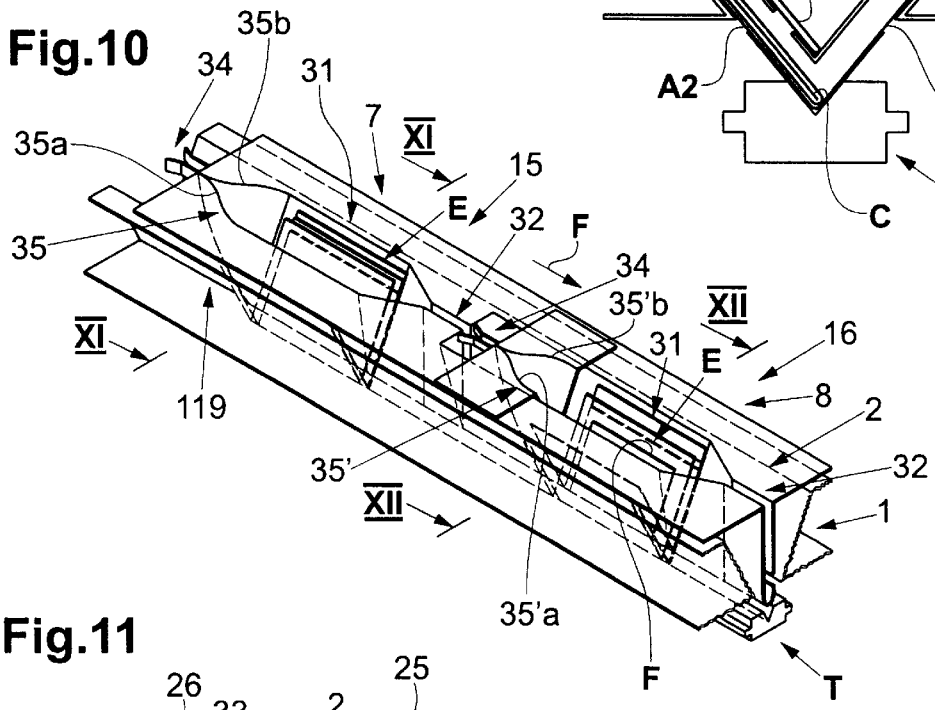
Fig.11
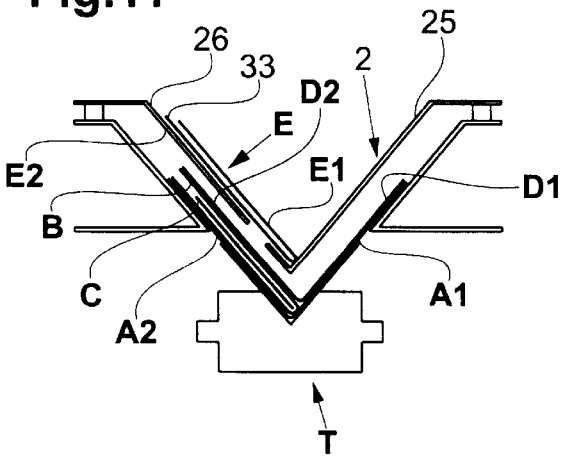
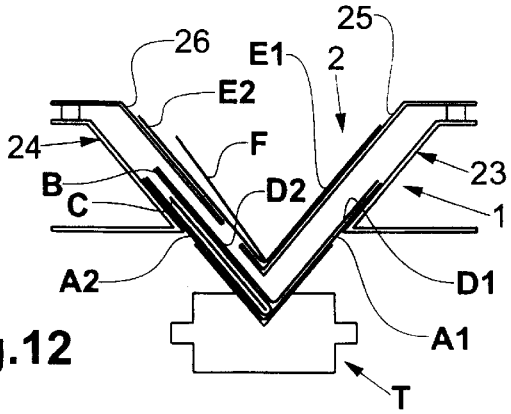
Fig.12

Fig.13
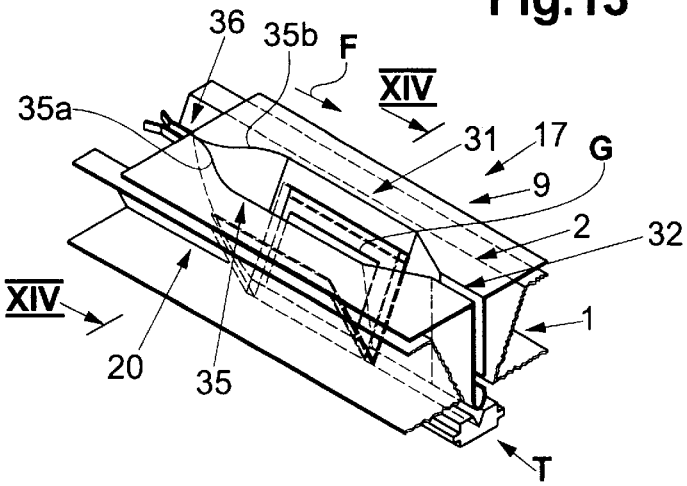
Fig.14
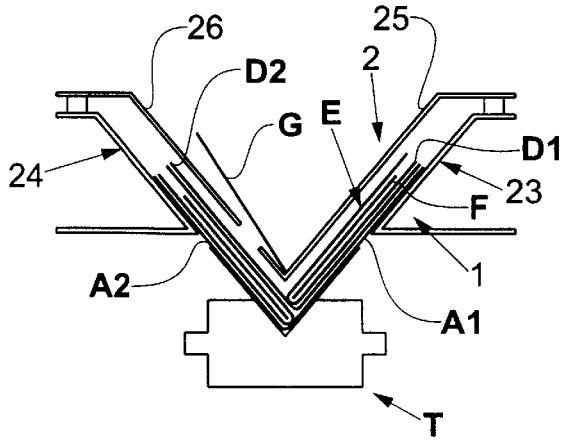
Fig.15
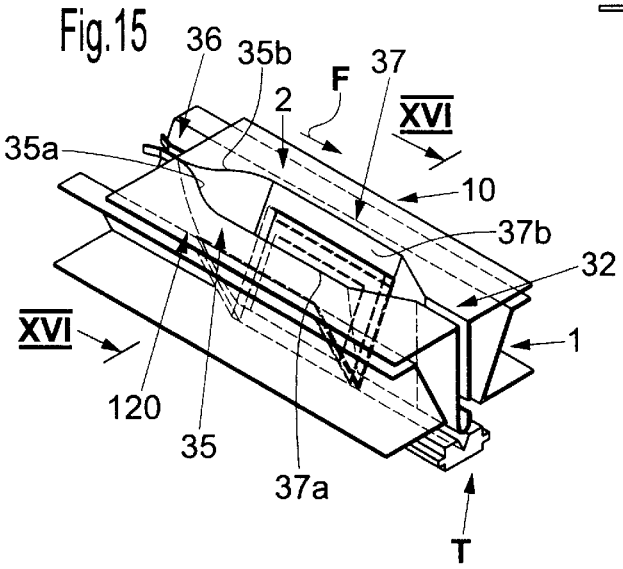
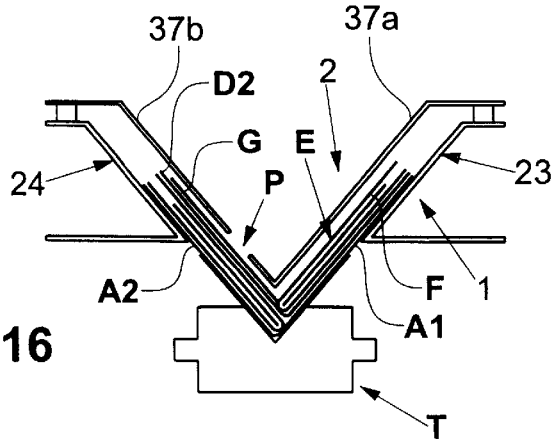
Fig.16

DEVICE FOR PRODUCING PRINTED MATERIALS IN SEVERAL PARTS

BACKGROUND OF THE INVENTION

The present invention relates to an apparatus for producing multi-part printed products which comprise a folded outer part and a number of inner parts arranged within the outer part.

In the case of known apparatuses of this type for producing multi-part printed products (EP-A-0 346 579 and the corresponding U.S. Pat. No. 5,116,033), a first folded product part, which serves as outer part, is introduced, at a first supply location, into the conveying channel and advanced along said conveying channel. The first product part is opened along the advancement route from the first supply location to the following, second supply location. At the second supply location, a second product part (inner part) is introduced into the open first product part. At the further, following supply locations, further product parts (inner parts) are introduced one after the other into the open first product part. In this case, said inner parts come to rest one beside the other or one inside the other, the respective inner parts in the last-mentioned case being opened before the next inner part is introduced. This results in an end product in the case of which a number of folded or non-folded inner parts are positioned in the first product part, which serves as outer part.

The object of the present invention, then, is to provide an apparatus of the type mentioned in the introduction which allows more freedom in putting together the end printed product, i.e. more freedom in the mutual arrangement of the inner parts in the outer part, than do the apparatuses known hitherto.

SUMMARY OF THE INVENTION

The above and other objects and advantages of the present invention are achieved by the provision of an apparatus which comprises a continuous conveying channel which is open toward the top and which defines a processing route, and a conveying arrangement for conveying product parts along the conveying channel. A plurality of supply locations are arranged one after the other along the processing route for supplying the outer part and the inner parts, and a processing channel is arranged above and aligned with the conveying channel. The processing channel is open toward the top and has individual successive processing regions, of which at least some are provided with input parts for receiving the product parts supplied at the supply locations. An advancement arrangement acts to advance the product parts along the processing channel, and through-passages are provided in the processing channel between certain successive processing regions which open toward the bottom and by means of which the product parts passing out of a processing region are transferred into the conveying channel located therebeneath.

As long as the product parts are located in the processing channel, they are accessible for manipulations such as opening and deflecting to one side or the other of the processing or conveying channel. This makes it possible, together with the specific transfer of the product parts from the processing channel into the conveying channel therebeneath, to influence the position of the inner product parts in relation to the outer part, on the one hand, and in relation to the other inner parts, on the other hand.

BRIEF DESCRIPTION OF THE DRAWINGS

An exemplary embodiment of the apparatus according to the invention is explained in more detail hereinbelow with reference to the drawings, in which, purely schematically and in simplified illustrations:

FIGS. 2–18 show, in a perspective illustration and in section in each case, the various successive processing regions of the apparatus according to FIG. 1.

DETAILED DESCRIPTION OF THE PREFERRED EMBODIMENTS

Figure 1:
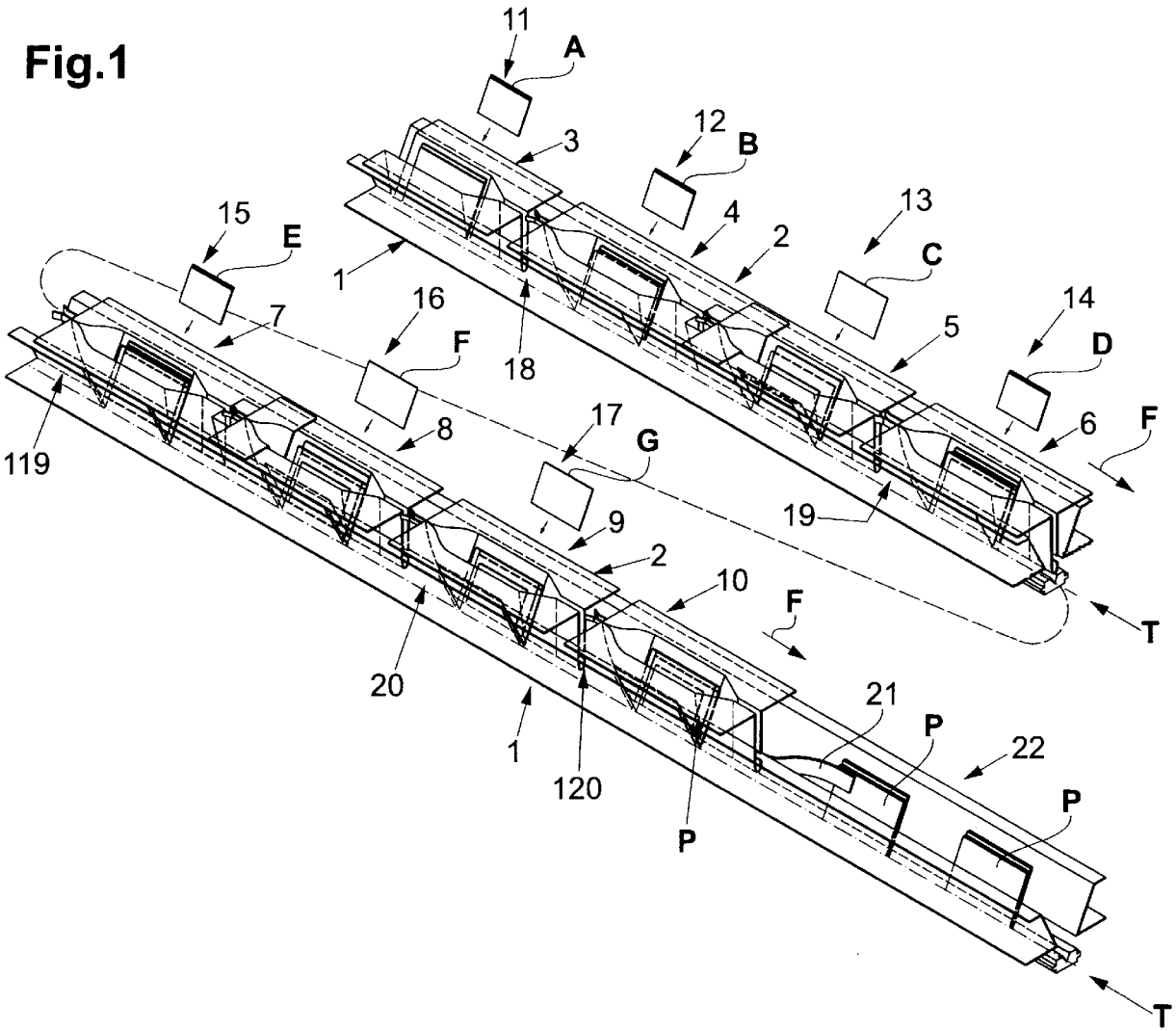
FIG. 1 shows, in perspective, an apparatus for producing multi-part printed products.

FIG. 1 shows a perspective, simplified illustration of an apparatus by means of which multi-part printed products, e.g. newspapers and periodicals, which comprise an outer part (cover) and inner parts inserted therein, can be produced. This apparatus, which, for space reasons, is illustrated in subdivided form in FIG. 1, has a continuous conveying channel 1 which is closed at the bottom, is open toward the top and, in the case of the exemplary embodiment shown, runs essentially rectilinearly and defines a processing route. Said conveying channel 1 is V-shaped in cross section. Arranged above the conveying channel 1, and such that it engages therein, is a processing channel 2 which is open toward the top and also extends in the direction of the processing route. The processing channel 2 is divided into successive processing regions 3 to 10. Supply locations 11 to 17 (not illustrated any more specifically in design terms) are provided one behind the other along the processing route. A folded product part A (main product), which forms the outer part of the finished printed product, is supplied at the supply location 11. The inner product parts B to G are supplied, and positioned in the outer part A in a manner which is still to be described, at the supply locations 12–17. In the case of the present exemplary embodiment, the inner parts B, D, E are folded product parts (preprinted products), while the inner parts C, F, G are single-part product parts (inserts).

The product parts located in the conveying channel 1 are advanced in the direction of the arrow F by means of a conveying arrangement T. An advancement device (not shown in FIG. 1) is provided in order to advance the product parts located in the processing channel 2.

Provided in the processing channel 2, between certain processing regions, are through-passages which allow the product parts to be transferred downward from the processing channel 2 into the conveying channel 1. There is thus provided, in the exemplary embodiment shown, a through-passage 18 between the processing regions 3 and 4, a through-passage 19 between the processing regions 5 and 6, a through-passage 119 between the processing regions 6 and 7, a through-passage 20 between the processing regions 8 and 9 and a through-passage 120 between the processing regions 9 and 10. In the processing region 10—although possible per se—no further product part is introduced into the still open end product P. At the end of this processing region 10, the finished end product P is closed by means of a diverting element 21 and positioned against one wall of the conveying channel 1. The closed end product P may then be removed from the conveying channel 1 in the end region 22 of the latter or be conveyed further along the conveying channel 1 to a processing station. It is also possible for the end product P, after leaving the processing region 10, to be conveyed further in the conveying channel 1, for example to a processing station, in the open state.

The construction of the apparatus shown in FIG. 1 and the operation of the same will now be explained in more detail with reference to FIGS. 2–23, the designations which are used in FIG. 1 also being used for FIGS. 2–23.

Figure 2:
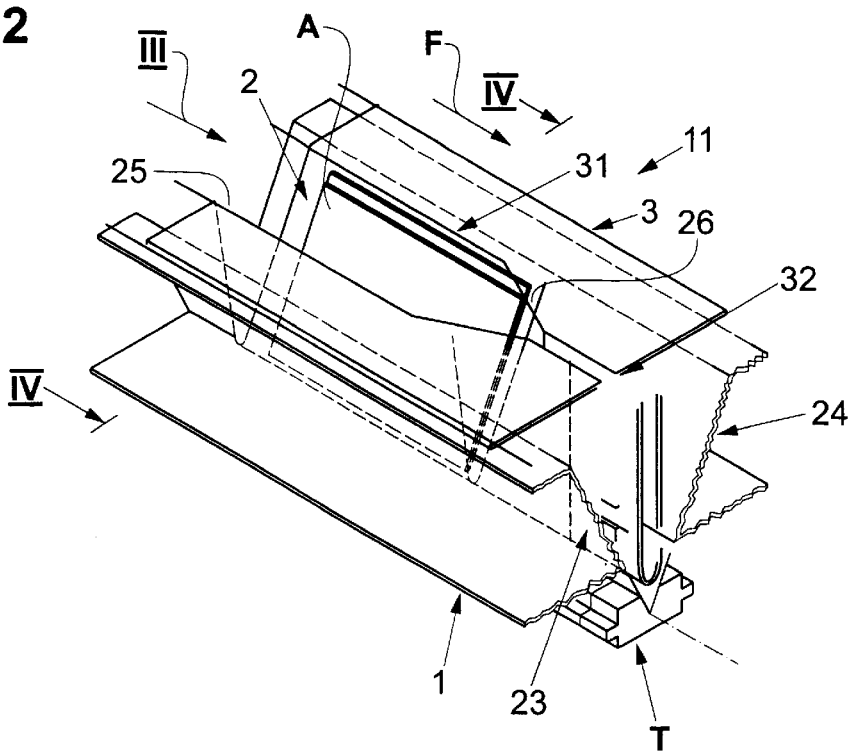
Figure 3:
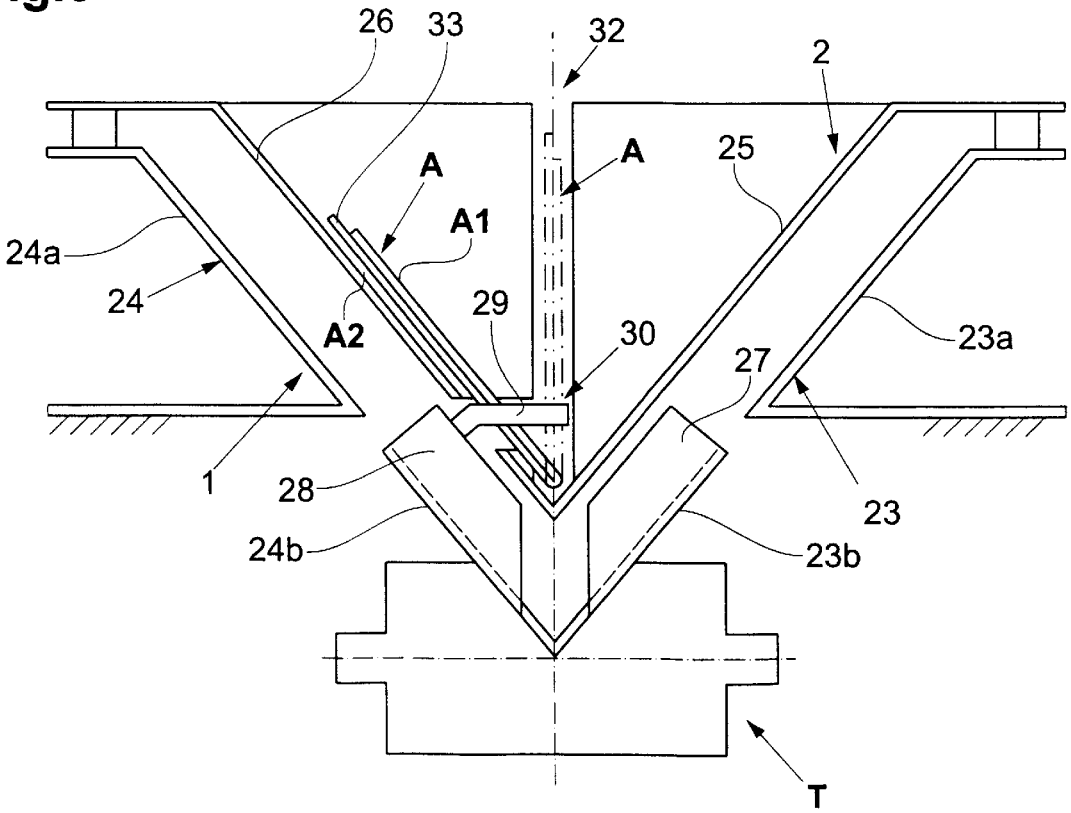

FIGS. 2–4 show the first processing region 3 in a perspective illustration (FIG. 2), in a view in the direction of the arrow III in FIG. 2 (FIG. 3) and in section along line IV—IV in FIG. 2 (FIG. 4). The conveying channel 1, which as has already been mentioned is V-shaped in cross section, has two oblique walls 23 and 24. These walls 23, 24 are subdivided into a fixed wall part 23*a*, 24*a* and a moving wall part 23*b*, 24*b*. The wall parts 23*b*, 24*b* form part of the conveying arrangement T (which otherwise is not illustrated any more specifically). In the region of the supply locations 11–17, the processing channel 2, which runs above the conveying channel 1 and is aligned therewith, likewise has a V-shaped cross section. The obliquely inclined side walls of the processing channel 2 are designated by 25 and 26.

The conveying arrangement T also contains carry-along elements 27, 28 (FIG. 3) which project into the conveying channel 1 and are fastened in pairs at regular intervals opposite one another on the moving wall parts 23*b*, 24*b*. For reasons of clarity, these carry-along elements 27, 28 are not shown in the following figures. Connected to the moving wall part 24*a* and/or to the carry-along elements 28 are fingers 29 which project into the processing channel 2 and belong to the advancement arrangement 30, which has already been mentioned in conjunction with FIG. 1. Said advancement arrangements serve for advancing in the conveying direction F product parts which are located in the processing channel 2. The fingers 29 are arranged, in the same way as the carry-along elements 27, 28, at regular intervals and are moved in the conveying direction F, i.e. in the direction of the processing route.

The processing region 3 has—in the same way as the other processing regions 4–9—an input part 31, which is adjoined in the conveying direction F by an aligning part 32. The product parts A to G to introduced into the input part 31 of the processing channel 2 in each case at the supply locations 11–17. By means of the aligning parts 32, the product parts which are input into the input part 31 are aligned, i.e. moved into an essentially vertical position, as is illustrated in FIG. 3 by the chain-dotted product part A. The product part leaving the aligning part 32 thus assumes a defined position as it runs into the respectively following processing region, which facilitates the further manipulations.

As FIGS. 2–4 show, the folded product part A is introduced into the processing channel 2 in the processing region 3, i.e. at the supply location 11. Said product part A forms the outer part of the finished end product and comprises two product halves A1 and A2, of which the product half A2 projects beyond the product part A1. The projecting portion of the product half A2 is designated by 33 and is referred to by specialists as an overfold. As FIGS. 2–4 show, the still closed product part A butts against the wall 26 of the processing channel 2.

Figure 20:
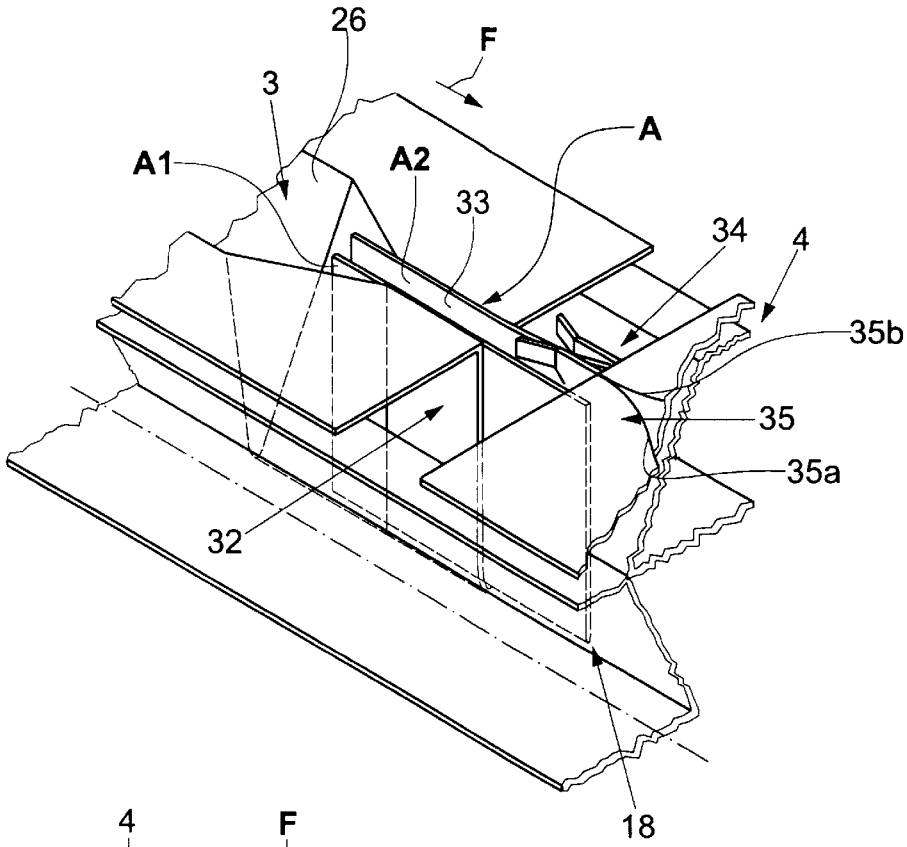
Figure 21:
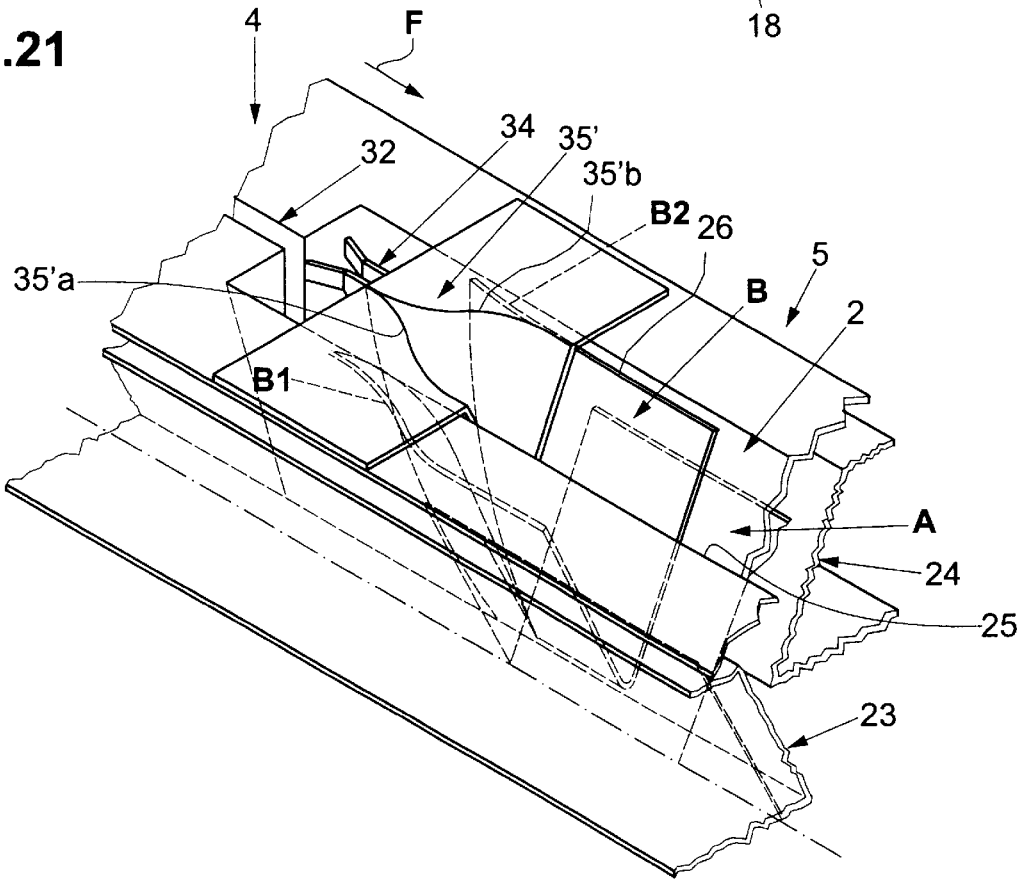
Figure 22:
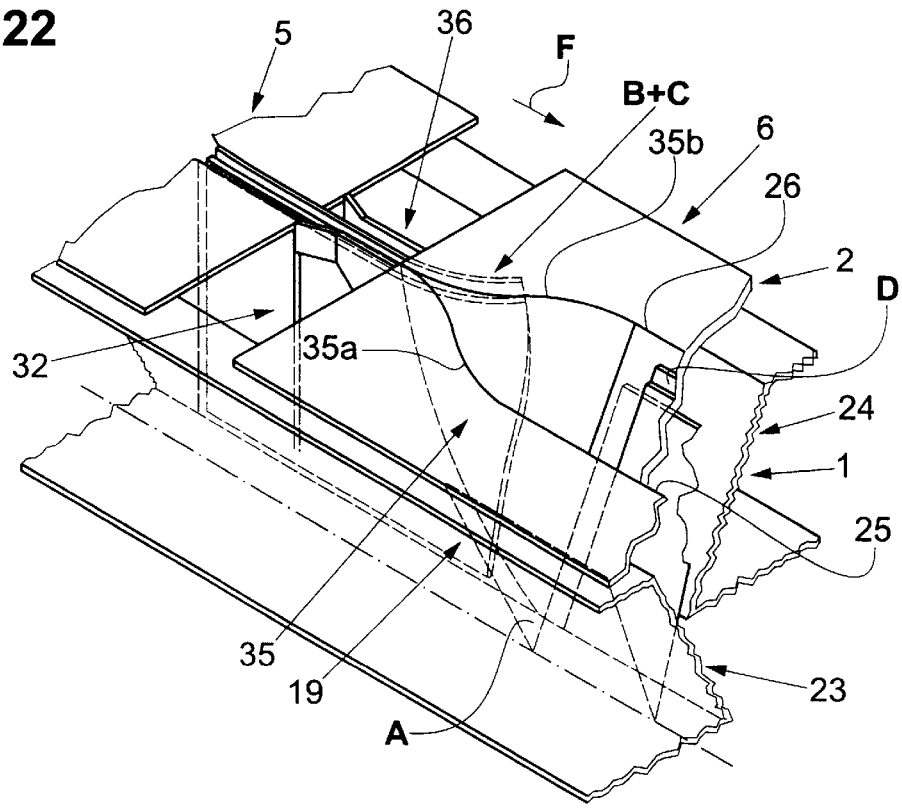
Figure 23:
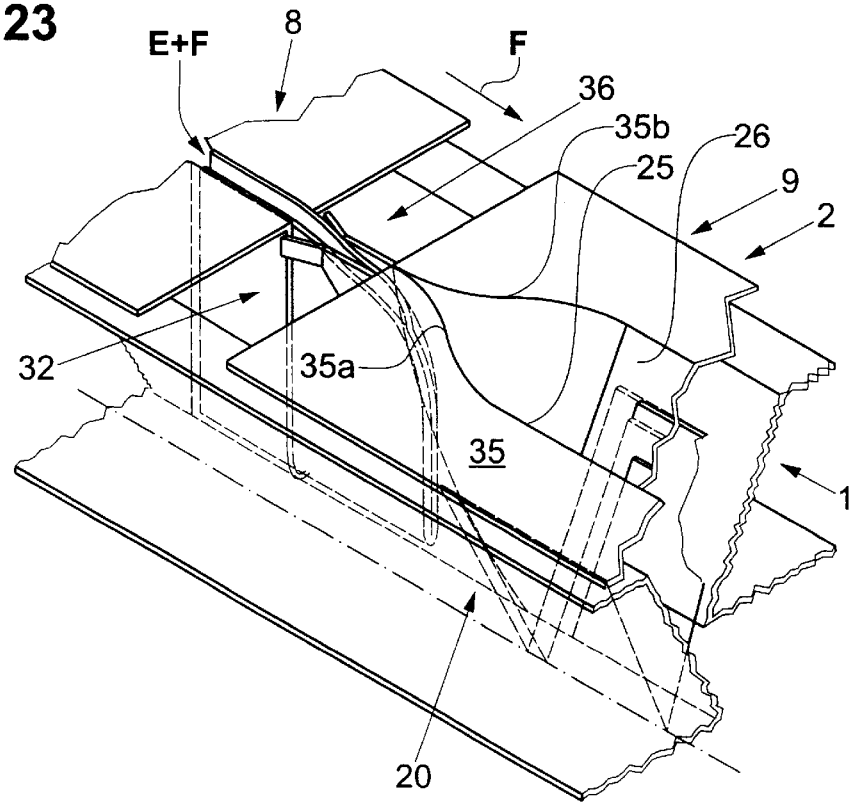

FIGS. 5–7 show the following processing regions 4 and 5 in perspective (FIG. 5) and in section along lines VI—VI and VII—VII in FIG. 5. The processing region 4 has an opening part 34 which is arranged upstream of the input part 31 and is directed toward the aligning part 32 of the preceding processing region 3. Said opening part 34 is followed by a directing part 35, which is designed here as a spreading part and has two directing walls 35*a* and 35*b* which diverge in the conveying direction F. As FIG. 20 shows, the product part A runs toward the opening part 34 as it leaves the aligning part 32 of the processing region 3, and said opening part comes to act on the projecting portion 33 of the product half A2 and, together with the directing part 35, causes the product part A to open i.e. causes the product halves A1 and A2 to spread apart from one another. The product part A opens here in a manner known per se, as is described in more detail, for example, in EP-A-0 080 185 and the corresponding U.S. Pat. No. 4,486,011. The open product part A passes through the through-passage 18 between the processing regions 3 and 4 and passes into the conveying channel 1 located therebeneath, as FIGS. 6 and 7 show. In this case, the product half A1 butts against the wall 23, and the product half A2 butts against the wall 24, of the conveying channel 1. The product part A, which was previously advanced by a finger 29 of the advancement arrangement 30, is then advanced along the conveying channel 1 by the carry-along elements 27 and 28.

The product part B is introduced into the input part 31 of the advancement channel 2 in the processing region 4, at the supply location 12. As has been mentioned, said product part B is likewise folded and, in the same way as the product part A, has two product halves B1 and B2, of which the product part B2 has a projecting portion 33. The closed product part B, butting against the wall 26, is advanced by the advancement arrangement 30, runs through the adjoining aligning part 32 and, in the same way as has been described with reference to the product part A, is opened by means of the opening part 34 and a directing part 35' as was shown in more detail in FIG. 21. The directing part 35' is inserted into the advancement channel 2. The directing walls 35*a*', 35*b*' of said directing part 35' form a through-passage gap with the walls 25, 26 of the advancement channel 2. In contrast to the product part A, however, the open product part B runs further in the advancement channel 2 and passes behind the directing walls 35*a*', 35*b*' of the directing part 35' to the input part 31 of the next processing region 5. In this processing region 5, the product part C is positioned in the open product part B, as can be seen from the right-hand part of FIG. 5 and from FIG. 7. The first product part A is located in the conveying channel 1 and the product parts B and C are located in the advancement channel 2 above the product part A (see FIG. 7).

In FIGS. 8 and 9, the next processing region 6 is shown in perspective and in section along line IX—IX in FIG. 8. At its inlet, said processing region has a diverting part 36 which is directed toward the aligning part 32 of the preceding processing region 5. Said diverting part 36 is adjoined by a directing part 35, which in this case serves as a deflecting part. As they are advanced, the product parts B and C run through the aligning part 32 of the processing region 5, which results in the product part B being closed. The product parts B and C are deflected to the left, as seen in the conveying direction F, by the diverting part 36 of the following processing region 6, as can be seen from FIG. 22. At the same time, the product part B, with the product part C inserted therein, passes downward through the through-passage 19 and drops into the open product part A. In this case, the directing wall 35*b* of the directing part 35 ensures that the product parts B and C are tilted to the left and come to rest on the product half A2, as can be seen from FIG. 9.

The product part D, which is folded in the same way as the product parts A and B, is positioned in the input part 31 of the processing region 6 at the supply location 14. In this case, the product half D2 likewise has a projecting portion 33.

The product part D, which is introduced into the processing channel 2 in the closed state (FIG. 9), is conveyed further through the adjoining aligning part 32 (FIG. 8) and runs toward the opening part 34 of the following processing region 7 (FIG. 10). In this case, the product part D is opened, by means of the opening part 34 and the directing part 35, as has already been explained in conjunction with the product part A. The open product part D passes downward through the through-passage 119 into the conveying channel 1. As can be seen from FIGS. 11 and 12, in which the processing regions 7 and 8 are shown in section along lines XI—XI and XII—XII, respectively, in FIG. 10, the product half D1 of the product part D comes to rest on the product half A1 of the product part A, while the other product half D2 comes to rest on the closed product part B.

FIGS. 10–12 show, as has already been mentioned, the two processing regions 7 and 8, which are of a similar construction to the processing regions 4 and 5 according to FIGS. 5–7. The folded product part E is introduced into the input part 31 of the processing region 7 at the supply location 15. Said product part has two product halves E1 and E2, the product half E2 projecting beyond the product half E1. The projecting portion of the product half E2 is designated by 33. Once the product part E has been introduced into the input part 31 of the processing region 7, the closed product part E butts against the side wall 26 of the processing channel 2 (FIG. 11). As it is conveyed further by a finger 29 of the advancement arrangement 30, the closed product part E runs through the adjoining aligning part 32 and passes to the opening part 34 of the following processing region 8. As has been described with reference to FIGS. 5–7, the product part E is opened by the opening part 34 and the adjoining directing part 35' and remains in the advancement channel 2. In the input part 31 of the processing region 8, the product half E1 of the product part E butts against the wall 25, and the product half E2 butts against the wall 26, of the processing channel 2, as FIG. 12 shows. The next product part F (insert) is then introduced into the open product part E at the supply location 16 and positioned on the product half E2, as can likewise be seen from FIG. 12. Located beneath the two product parts E and L [sic] in the conveying channel 1, are the open product part A, the closed product part B, with the product part C located in the interior of the latter, and the open product part D, which rests on the product half A1 of the product part A by way of the product half D1 and on the product half B2 of the product part B by way of the other product half D2, as can be seen from FIGS. 11 and 12.

FIGS. 13 and 14 show the processing region 9 in a perspective illustration and in section along the line XIV—XIV of FIG. 13. This input portion 9 has a diverting part 36 directed toward the aligning part 32 of the preceding processing region 8. The closed product part E with inner product part F, which is leaving the aligning part 32 of the processing region 8, is deflected to the right, as seen in the conveying direction F, by the diverting part 36 of the processing region 9, as can be seen from FIG. 23. In this case, the product parts E and F are guided by the directing wall 35*a* of the directing part 35. The two product parts E and F pass through the through-passage 20 between the processing regions 8 and 9 and pass into the guide channel 1 located therebeneath, where they come to rest on the product half D1 of the open product part D (see FIG. 14).

The last product part G, which in the present exemplary embodiment is defined as a non-folded insert, is introduced into the input part 31 of the processing region 9 at the supply location 17. The product part G comes into abutment against the wall 26 of the advancement channel 2, as FIG. 14 shows. As can also be seen from FIG. 14, the product parts A to F are located beneath the product part G in the conveying channel 1.

The product parts A to F and the product part G are advanced further in the direction of the arrow F by the conveying arrangement T and by the advancement arrangement 30, respectively. In this case, the product part G runs through the aligning part 32 of the processing region 9 and is then deflected to the left, as seen in the conveying direction F, by the diverting part 36 of the last processing region 10 (see FIGS. 15 and 16). In addition, the product part G is guided downward, through the through-passage 120 between the processing regions 9 and 10, into the conveying channel 1. As shown [sic] from FIG. 16, which constitutes a section along line XVI—XVI in FIG. 15, the product part G, which as has been mentioned is deflected to the left, comes to rest on the product half D2 of the product part D.

No further product parts are supplied in this last processing region 10. The processing region 10 thus does not have an input part 31. The latter is replaced by a guide part 37 (FIG. 15), of which obliquely downwardly sloping walls 37*a*, 37*b* correspond to the side walls 25, 26 of the advancement channel 2. The processing region 10 may thus be of the same design as, for example, the processing region 6 (FIG. 8).

Figure 17:
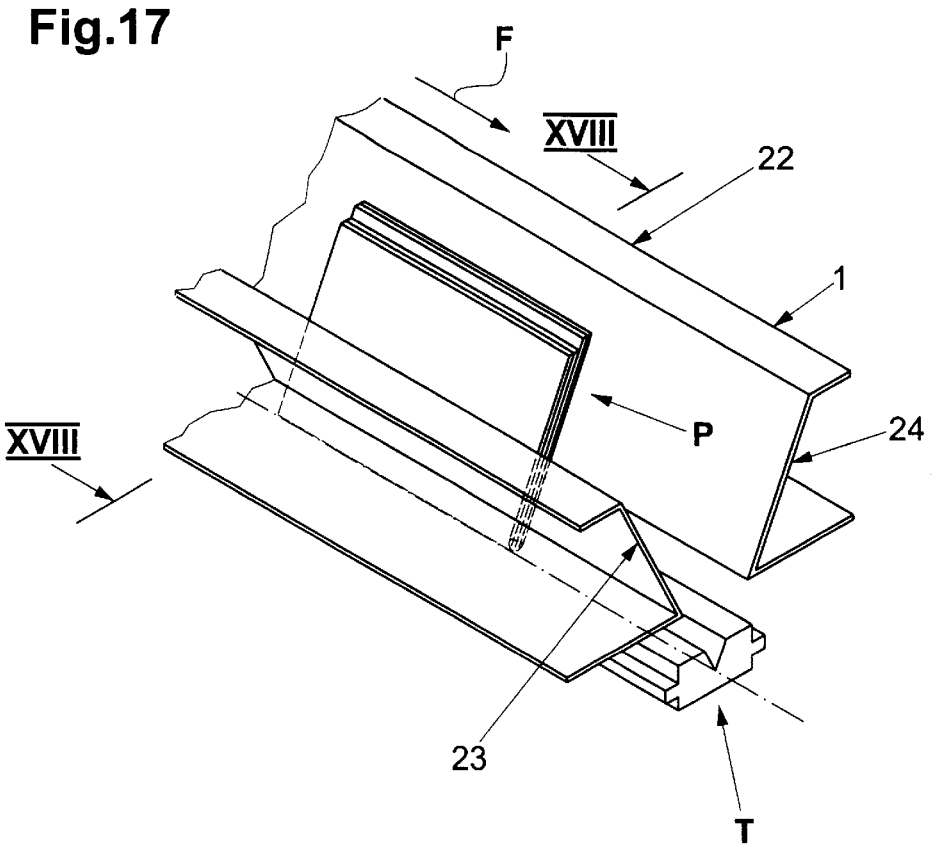
Figure 18:
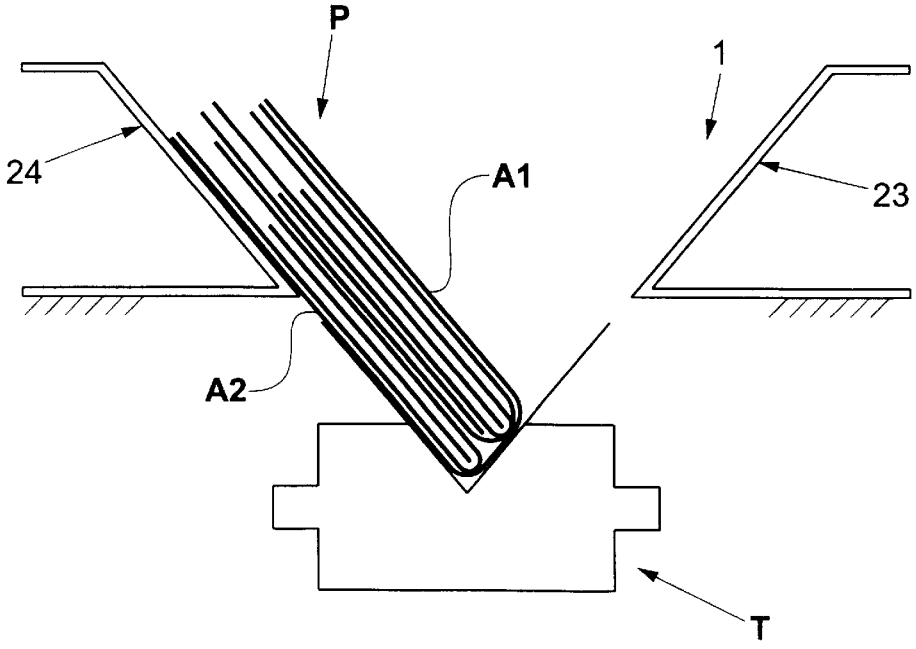

The definitively put-together end product P, which is located in the processing region 10 in the conveying channel 1, is still open and is guided past the diverting element 21 as it is advanced further by the conveying arrangement T. This diverting element 21 closes the end product P and positions it against the left-hand side wall 24 of the conveying. channel 1, as seen in the conveying direction F. FIG. 17 and FIG. 18, which constitutes [sic] a section along line XVIII—XVIII in FIG. 17, show the finished printed product P butting against the side wall 24 of the conveying channel 1 in the end region 22.

Figure 19:
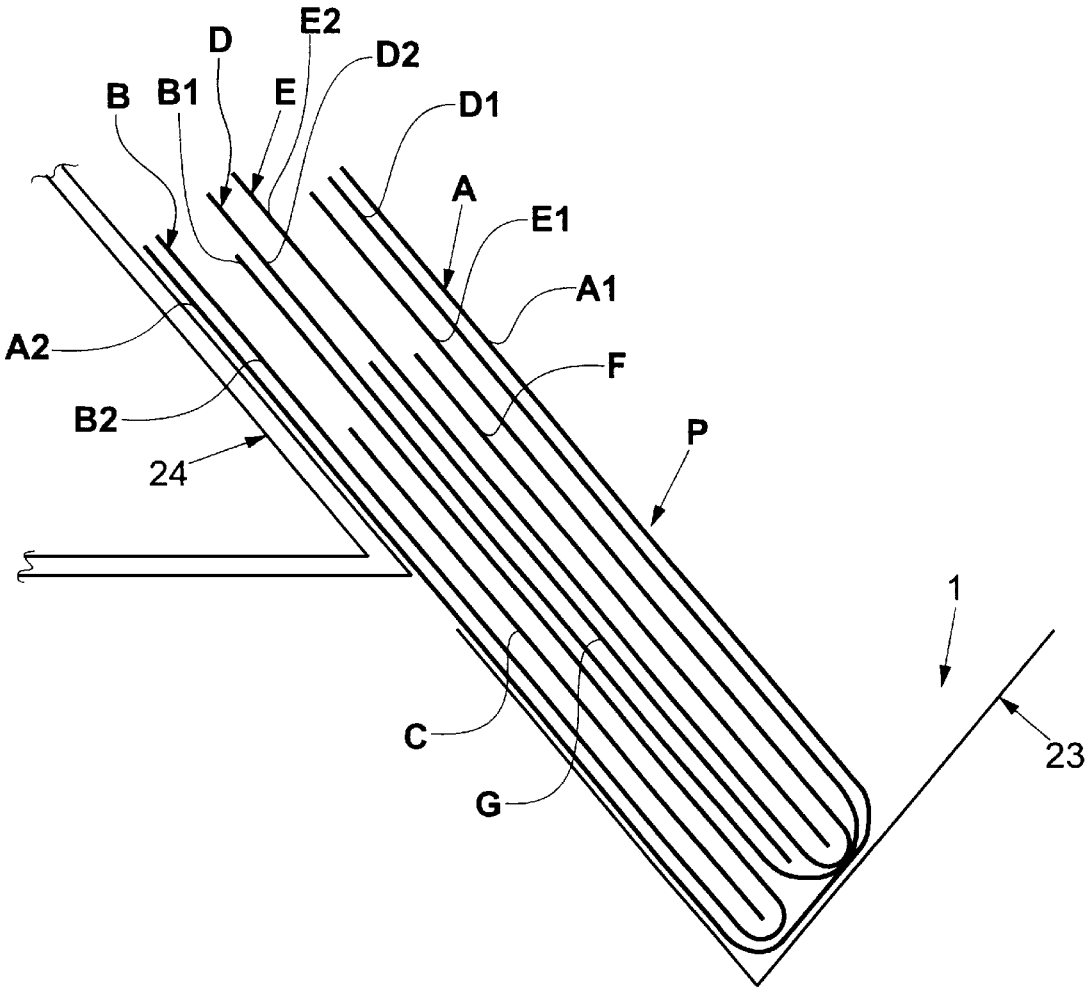
FIG. 19 shows, on a larger scale than FIG. 18, a cross section through a finished end printed product located in the conveying channel, FIGS. 20–23 each show a perspective illustration of various transitions from one processing region into the following processing region of the apparatus.

The composition of the finished end product P can be seen from FIG. 19 which constitutes a detail of FIG. 18 on an enlarged scale. The outer part (cover) of the end product P is formed by the product part A. All the other product parts (inner parts) B to G are located between the product halves A1 and A2 of the folded outer part A. The product half A2 has adjacent to it the folded product part B, in the interior of which the product part C is located. Butting against the product half B1 of the product part B is the product half D2 of the folded product part D, which serves as a cover for the product parts E, F and G. The product part F is located in the interior of the folded product part E. The product part G is arranged between the product half D2 and the product half E2 of the product parts D and E. The end product part P thus comprises, on the one hand, product parts inserted one inside the other and, on the other hand, product parts located one beside the other, it being the case that the position of the individual product parts, i.e. in the illustration of FIG. 19 the sequence of the product parts from left to right, is determined by the design of the processing channel 2, more specifically by the arrangement of the through-passages between the processing regions 3–10 and the arrangement and design of the opening part 34 and of the diverting parts 36.

It can readily be seen, from what has been said above, that it is possible to change the composition of the end product P, i.e. the arrangement of the inner parts in the outer parts, with few modifications in the processing channel 2, namely by way of a different arrangement of the through-passages between the processing regions and/or by exchanging an opening part 34 for a diverting part 36 and vice versa and changing over the diverting direction of the diverting parts 36 (to the left or to the right).

Figure 24:
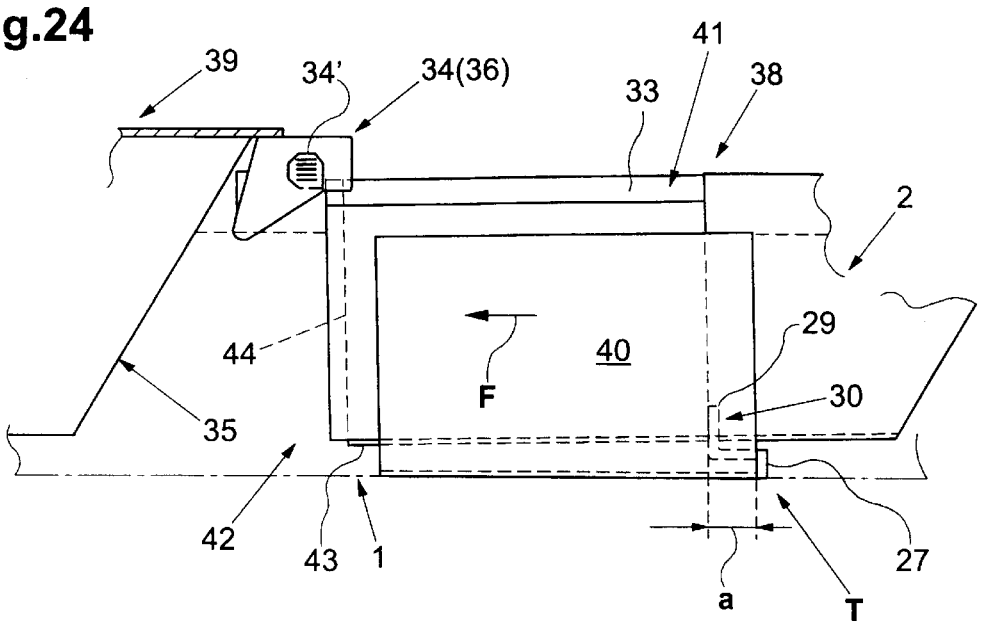
FIG. 24 shows a longitudinal section of a portion of the apparatus according to FIG. 1, FIGS. 25 and 26 each show a plan view of the processing channel in the transition from one processing region to the following processing region as a product part is deflected laterally, FIGS. 27 and 28 each show a plan view of the processing channel in the transition from one processing region to the following processing region as a product part is opened.

The sectional FIG. 24, then, will be used to explain in more detail the configuration of the conveying and processing channels 1, 2 in the region of a transition from a processing region designated by 38 to the following processing region, designated by 39.

The product part located in the conveying channel 1 is designated by 40 and is advanced by the conveying arrangement T. In this case, the carry-along element 27 acts on the trailing edge of the product part 40. Located in the processing channel 2 is a product part which is designated by 41 and is illustrated as a two-part, folded product part with a projecting portion 33. In order to advance said product part 41, use is made of a finger 29 of the advancement arrangement 30. Said finger 29 likewise acts on the trailing edge of the product part 41. As can be seen from FIG. 24, the finger 29 of the advancement arrangement 30 is offset in relation to the carry-along element 27 of the conveying arrangement T by the distance a, to be precise it is offset forward as seen in the conveying direction F. This measure ensures that the product part 41 does not come to rest on the carry-along element 27 of the conveying arrangement T once it has run through the through-passage 42 between the processing regions 38 and 39 and has dropped downward into the conveying channel 1. This ensures that the product part 41 is carried along by the conveying arrangement T.

FIG. 24 shows that the base 43 of the processing channel 2 may be inclined downward in the conveying direction F, in order to facilitate transfer of the product part 41 into the conveying channel 1. The through-passage 42 formed between that end of the processing region 38 of the processing channel 2 which is designated by 44 and the directing part 35 of the next processing region 39. The opening part 34 or the diverting part 36 is arranged upstream of the directing part 35, as seen in the conveying direction F. The opening part 34 may be designed, for example, as shown in FIGS. 5–10. It is indicated in FIG. 24 that the opening part 34 may also be designed as a so-called vacuum opener 34', which subjects one product half to negative pressure in a known manner.

Figure 25:
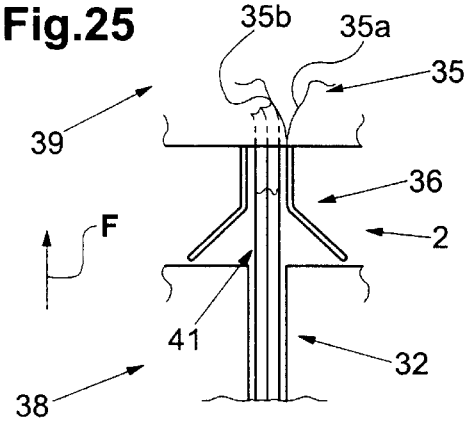
Figure 26:
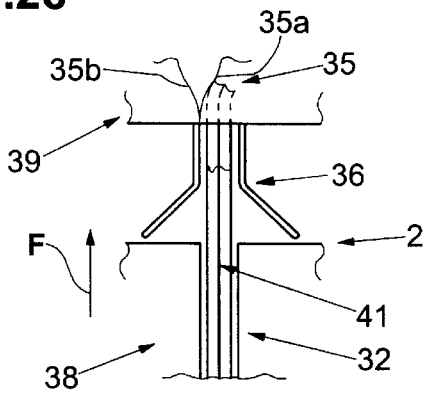

FIGS. 25–28 show plan views in each case of the product part 41 of FIG. 24 in the transition from the processing region 38 into the adjoining processing region 39. In the case of FIGS. 25 and 26, the processing region 39 has a directing part 35, which deflects the product part 41 either to the left (FIG. 25) or to the right (FIG. 26), as seen in the conveying direction F. In one case, the product part 41 is guided along the directing wall 35*b*, and in the other case it is guided along the other directing wall 35*a*, of the directing part 35.

Figure 27:
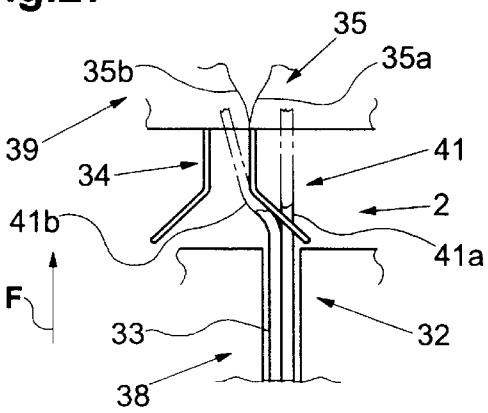
Figure 28:
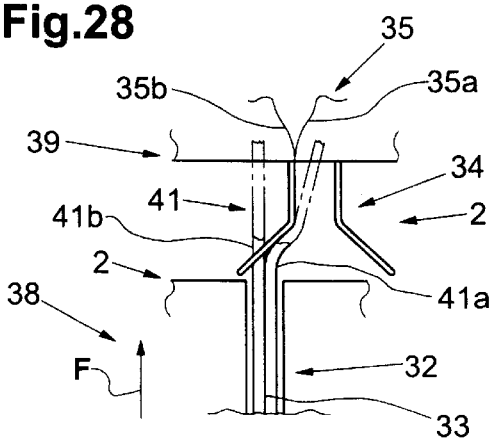

In the illustration of FIGS. 27 and 28, the processing region 39 is provided on the inlet side with an opening part 34, which acts on the projecting portion 33 of one product half 41*b* or 41*a* of the product part 41. In the illustration of FIG. 27, the left-hand product half 41, as seen in the conveying direction F, is provided with the projecting portion 33, while, in the illustration of FIG. 28, the right-hand product half 41*a* has the projecting portion 33. Accordingly, the position of the opening part 34 in relation to the following directing part 35 differs in FIGS. 27 and 28.

Figure 29:
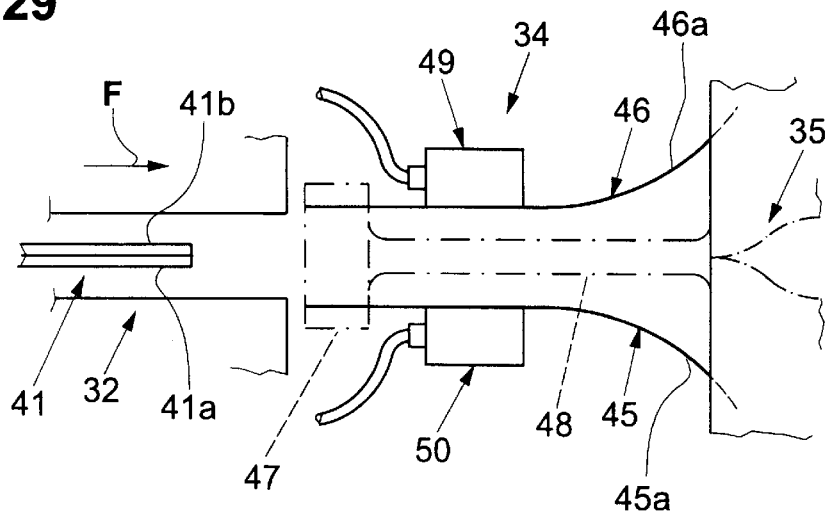
FIGS. 29–31 show a plan view of another embodiment of an opening arrangement.
Figure 30:
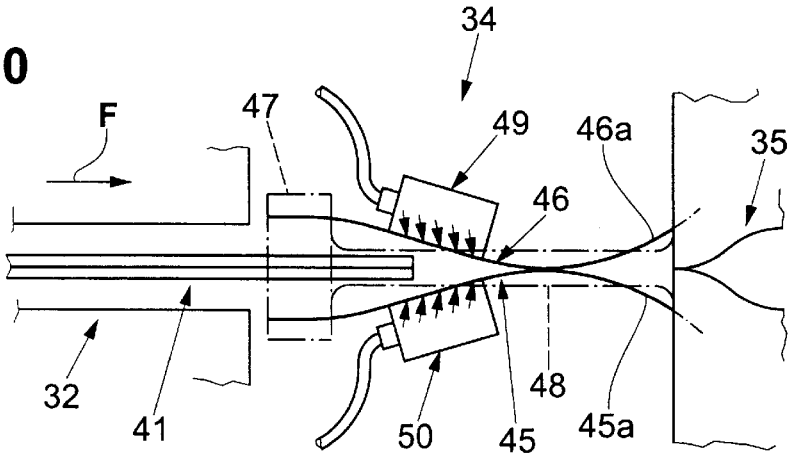
Figure 31:
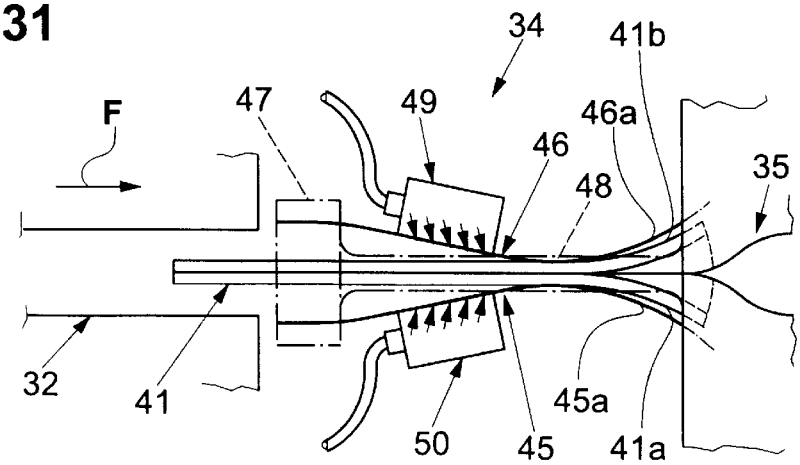

FIGS. 29–31 illustrate a different embodiment of an opening part 34 in various operating phases, corresponding parts being provided with the same designations as in the preceding figures.

FIG. 29, which shows the opening part 34 in the rest state, best shows the construction of said opening part 34. The opening part 34 has two thin directing plates 45 and 46 which extend in the conveying direction F, are located opposite one another and consist of a resilient material, e.g. of spring steel. Said directing plates 45, 46 are fastened on a mount 47 at their end which is directed toward the aligning part 32 of the preceding processing region. At the other, free end, 45*a*, 46*a*, the directing plates 45, 46 are bent outward, i.e. away from the opposite directing plate. The mount 47 is fitted on a stationary component of the adjoining processing region via a support 48. Connected to each directing plate 45, 46 is a nozzle head 49 or 50, which is connected to a compressed-air source (not illustrated specifically). The nozzle heads 49 and 50 do not have compressed air admitted to them in the illustration according to FIG. 29. The two directing plates 45 and 46 are located in their basic position, in which they run approximately parallel to one another in the conveying direction F.

If the nozzle heads 49, 50 are connected to compressed-air source, then the air passing out of the nozzle heads 49, 50 flows along the directing plates 45, 46, to be precise on the side which is directed toward the other directing plate in each case. This then results in the directing plates 45, 46 moving toward one another and coming into abutment against one another, as is shown in FIG. 30. This type of operation is known as the "Coanda effect".

FIG. 31, then, shows the way in which the opening operation progresses.

Once it has left the aligning part 32 of the preceding processing region, the product part 41 which is to be opened passes between the directing plates 45, 46 and is moved past said directing plates 45, 46 in the conveying direction F. The air which continues to flow along the directing plates 45, 46 positions the product halves 41*a* and 41*b* against the directing plates 45, 46. Since the directing plates 45, 46 are bent outward at their free end 45*a*, 46*a*, and thus diverge from one another, the product halves 41*a* and 41*b* are lifted off from one another, as FIG. 31 shows. The product part 41, which is open in this way in the region of the leading edge, is transported further to the directing part 35. The two product halves 41*a* and 41*b* are laterally guided past the directing part 35, which, as has already been explained, results in the product 41 being opened fully.

With an opening part 34 according to FIGS. 29–31, in the case of which the Coanda effect is used, it is not necessary for one of the two product halves to be provided with a projecting portion 33.

A number of variants will now additionally be pointed out hereinbelow.

Both the outer part A and the inner parts B, D and E may comprise two or more folded sheets located one inside the other.

It is also conceivable for opening means or diverting means for respectively opening or diverting the end product P also to be provided in the conveying channel 1 downstream of the processing region 10.

It is also possible to provide along the processing route, between the supply locations 11–17 or downstream of the latter, processing stations, e.g. cutting or stitching stations, for respectively trimming or wire stitching of certain product parts or the end product part P, or adhesive-bonding stations, at which the product parts supplied are connected to other product parts by means of adhesive.

On the other hand, it is possible to dispense with diverting parts 36 if the product parts, rather than being in the vertical position as shown, are already in an oblique position, i.e. inclined to the left or right, as they pass out of a processing region. In this case too, the directing parts 35 ensure that the product part maintains its oblique position through the processing region.

The conveying channel 1 and thus also the advancement channel 2 may also have, rather than the rectilinear progression shown, a wholly or partially curved progression and also define a continuous processing route.

The apparatus described may be constructed differently, depending on the desired composition of the end product. By virtue of an appropriate configuration of the processing regions, i.e. of the mutual arrangement and design of the opening parts 34, of the directing parts 35, 35' and of the diverting parts 36 and also of the input parts 31, it is possible to select the type of end product and the arrangement of the product parts within extremely wide limits. It is thus possible, in particular, to produce end products merely by way of insertion of the product parts in each case into the open, previously supplied product part, this corresponding to collection from the outside to the inside. In addition, with a suitable configuration of the apparatus described, it is also possible to produce end products in which the product parts are located one beside the other (collation). Such an end product, then, does not have an outer product part (cover) in which the other product parts are positioned. However, it is also possible to produce such an end product, formed by collation, in which, with folded product parts, a further product part is inserted into all of these folded product parts, or into some of these individually. Such an end product would be provided, for example, if in the illustration of FIG. 11, with no product part A, the product parts B, C, D located in the conveying channel 1 were to form the end product.

What is claimed is:

1. An apparatus for producing multi-part printed products which comprise a folded outer part and a number of inner parts arranged within the outer part, comprising a continuous conveying channel which is open toward the top and which defines a processing route, a conveying arrangement for conveying product parts along the conveying channel, a plurality of supply locations arranged one after the other along the processing route for supplying the outer part and the inner parts, a processing channel arranged above and aligned with the conveying channel, and which is open toward the top and has individual successive processing regions, of which at least some are provided with input parts for receiving the product parts supplied at the supply locations, an advancement arrangement for advancing the product parts along the processing channel, and wherein through-passages are provided in the processing channel between certain successive processing regions which open toward the bottom and by means of which the product parts passing out of a processing region are transferred into the conveying channel located therebeneath.

2. The apparatus according to claim 1, wherein the conveying channel is V-shaped in cross section.

3. The apparatus according to claim 2, wherein the processing channel is V-shaped in cross section at least in the region of the input parts.

4. The apparatus according to claim 1, wherein at least some of the processing regions are provided with opening parts for opening multi-leaf product parts.

5. The apparatus according to claim 4, wherein the opening parts are arranged in an initial section of the associated processing region as seen in the conveying direction of the product parts, and act on the product parts which have been introduced in the preceding processing region as said product parts run past the opening part.

6. The apparatus according to claim 4, wherein a directing part is arranged downstream of the opening part as seen in the conveying direction of the product parts, and is arranged approximately centrally in the processing channel and configured for holding open or completely opening the product parts.

7. The apparatus according to claim 1, wherein at least some of the processing regions are provided with diverting parts for laterally deflecting the product parts.

8. The apparatus according to claim 7, wherein the diverting parts are arranged in an initial section of the associated processing region as seen in the conveying direction of the product parts, and act on the product parts which have been introduced in the preceding processing region as said product parts run past the diverting part.

9. The apparatus according to claim 7, wherein a directing part is arranged downstream of each diverting part as seen in the conveying direction of the product parts, and is arranged approximately centrally in the processing channel and past which the product parts run laterally.

10. The apparatus according to claim 4, wherein the processing regions have an aligning part which is arranged downstream of the input part as seen in the conveying direction of the product parts, and through which the product parts run and are thus moved into an approximately vertical position.

11. The apparatus according to claim 1, wherein the conveying arrangement and the advancement arrangement include conveying elements which act on the product parts located in the conveying channel and in the advancement channel, the conveying elements of the conveying arrangement and the conveying elements of the advancement arrangement being driven synchronously.

12. The apparatus according to claim 4, wherein the opening part has two elongate directing elements which extend in the conveying direction of the product parts and define between them a through-path for the product parts which are to be opened, said directing elements being elastically deflectable transversely to their longitudinal extend, and a compressed air outlet on at least one of the directing elements which is located on the side thereof which is directed toward the other directing element for delivering compressed air such that an air flow is produced along the directing elements.

13. The apparatus according to claim 12, wherein the elongate directing elements, at their front end as seen in the conveying direction of the product parts, are fastened on a mount and, at the other rear end, are curved in a direction which leads away from the other directing element.

14. The apparatus according to claim 1, wherein a plurality of processing stations are arranged along the processing route at which the product parts are subjected to processing steps.

* * * * *